US007874904B2

(12) United States Patent
Randall

(10) Patent No.: US 7,874,904 B2
(45) Date of Patent: Jan. 25, 2011

(54) GAMING DEVICE HAVING A COMPOSITE GAME WITH POTENTIAL AWARD-GENERATING GAME OR EVENT AND GUARANTEED AWARD-GENERATING GAME OR EVENT

(75) Inventor: Dov Liam Randall, Las Vegas, NV (US)

(73) Assignee: IGT, Reno, NV (US)

( * ) Notice: Subject to any disclaimer, the term of this patent is extended or adjusted under 35 U.S.C. 154(b) by 925 days.

(21) Appl. No.: 11/205,680

(22) Filed: Aug. 17, 2005

(65) Prior Publication Data

US 2007/0042824 A1 Feb. 22, 2007

(51) Int. Cl.
*A63F 9/24* (2006.01)

(52) U.S. Cl. ..... 463/16

(58) Field of Classification Search ..... 463/16
See application file for complete search history.

(56) References Cited

U.S. PATENT DOCUMENTS

| | | | |
|---|---|---|---|
| 2,743,108 | A | 4/1956 | Sanders |
| 3,904,207 | A | 9/1975 | Gold |
| 4,621,814 | A | 11/1986 | Stepan et al. |
| 4,695,053 | A | 9/1987 | Vazquez, Jr. et al. |
| 4,775,155 | A | 10/1988 | Lees |
| 4,838,552 | A | 6/1989 | Hagiwara |
| 4,856,787 | A | 8/1989 | Itkis |
| 4,874,173 | A | 10/1989 | Kishishita |
| 4,991,848 | A | 2/1991 | Greenwood et al. |
| 5,116,055 | A | 5/1992 | Tracy |
| 5,152,529 | A | 10/1992 | Okada |
| 5,205,555 | A | 4/1993 | Hamano |
| 5,342,047 | A | 8/1994 | Heidel et al. |

(Continued)

FOREIGN PATENT DOCUMENTS

EP 0 449 433 10/1991

(Continued)

OTHER PUBLICATIONS

3 Reel Holdup Article written by Strictly Slots, published Sep. 2000.

(Continued)

*Primary Examiner*—Dmitry Suhol
*Assistant Examiner*—Malina K Rustemeyer
(74) *Attorney, Agent, or Firm*—K&L Gates LLP

(57) ABSTRACT

A gaming device and a method of operating a gaming device which include at least one potential award-generating event and at least one guaranteed award-generating event. The award-generating events can include independent games of a composite game or independent plays of a game. For each occurrence of a potential award-generating event, at least one guaranteed award-generating event occurs to provide the player at least one award. In an embodiment, the award-generating events occur simultaneously by being simultaneously displayed to a player and simultaneously played. Even if a terminating event occurs in the potential or guaranteed award-generating event, an award is provided to the player in the guaranteed award-generating event. In an embodiment, the potential award-generating event includes an advancement game and the guaranteed award-generating event includes a random selection game. In an embodiment, if a predetermined number of awards provided to a player are associated with an accumulation indicator, the player is provided an additional award.

32 Claims, 10 Drawing Sheets

U.S. PATENT DOCUMENTS 5,393,057 A 2/1995 Marnell, II
5,393,061 A 2/1995 Manship et al.
5,395,111 A 3/1995 Inoue
5,407,200 A 4/1995 Zalabah
5,411,271 A 5/1995 Mirando
5,449,173 A 9/1995 Thomas et al.
5,456,465 A 10/1995 Durham
5,536,016 A 7/1996 Thompson
5,569,084 A 10/1996 Nicastro et al.
5,584,764 A 12/1996 Inoue
5,609,524 A 3/1997 Inoue
5,611,730 A 3/1997 Weiss
5,639,089 A 6/1997 Matsumoto et al.
5,641,730 A 6/1997 Brown
5,645,486 A 7/1997 Nagao et al.
5,655,961 A 8/1997 Acres et al.
5,697,843 A 12/1997 Manship et al.
5,704,835 A 1/1998 Dietz, II
5,722,891 A 3/1998 Inoue
5,755,619 A 5/1998 Matsumoto et al.
5,769,716 A 6/1998 Saffari et al.
5,775,692 A 7/1998 Watts et al.
5,788,573 A 8/1998 Baerlocher et al.
5,823,873 A 10/1998 Moody
5,823,874 A 10/1998 Adams
D400,597 S 11/1998 Hedrick et al.
5,833,537 A 11/1998 Barrie
5,848,932 A 12/1998 Adams
5,851,148 A 12/1998 Brune et al.
5,876,284 A 3/1999 Acres et al.
5,882,261 A 3/1999 Adams
5,890,962 A 4/1999 Takemoto
5,893,718 A 4/1999 O'Donnell
5,927,714 A 7/1999 Kaplan
5,935,002 A 8/1999 Falciglia
5,947,820 A 9/1999 Morro et al.
5,976,016 A 11/1999 Moody et al.
5,980,384 A 11/1999 Barrie
5,984,781 A 11/1999 Sunaga
5,984,782 A 11/1999 Inoue
5,997,401 A 12/1999 Crawford
6,007,066 A 12/1999 Moody
6,015,346 A 1/2000 Bennett
6,019,369 A 2/2000 Nakagawa et al.
6,056,642 A 5/2000 Bennett
6,059,289 A 5/2000 Vancura
6,059,658 A 5/2000 Mangano et al.
6,089,976 A 7/2000 Schneider et al.
6,089,977 A 7/2000 Bennett
6,089,978 A 7/2000 Adams
6,093,102 A 7/2000 Bennett
6,102,798 A 8/2000 Bennett
6,120,377 A 9/2000 McGinnis, Sr. et al.
6,126,541 A 10/2000 Fuchs
6,126,542 A 10/2000 Fier
6,126,547 A 10/2000 Fier
6,135,884 A 10/2000 Hedrick et al.
6,142,873 A 11/2000 Weiss et al.
6,142,874 A 11/2000 Kodachi et al.
6,142,875 A 11/2000 Kodachi et al.
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,186,894 B1 2/2001 Mayeroff
6,210,279 B1 4/2001 Dickinson
6,217,448 B1 4/2001 Olsen
6,227,971 B1 5/2001 Weiss
6,238,287 B1 5/2001 Komori et al.
6,270,412 B1 8/2001 Crawford et al.
6,315,666 B1 11/2001 Mastera et al.
6,347,996 B1 2/2002 Gilmore et al.
6,394,902 B1 5/2002 Glavich et al.
6,398,644 B1 6/2002 Perrie et al.
6,413,162 B1 7/2002 Baerlocher et al.
6,428,412 B1 8/2002 Anderson et al.
6,443,837 B1 9/2002 Jaffe et al.
6,461,241 B1 10/2002 Webb et al.
6,464,582 B1 10/2002 Baerlocher et al.
6,481,713 B2 11/2002 Perrie et al.
6,482,089 B2 11/2002 Demar et al.
6,533,658 B1 3/2003 Walker et al.
6,547,242 B1 4/2003 Sugiyama et al.
6,565,436 B1 5/2003 Baerlocher
6,645,073 B2 11/2003 Lemay et al.
6,652,378 B2 11/2003 Cannon et al.
6,656,040 B1 12/2003 Brosnan et al.
6,682,419 B2 1/2004 Webb et al.
6,682,420 B2 1/2004 Webb et al.
6,749,501 B2 6/2004 Crawford
6,837,788 B2 1/2005 Cannon
6,857,958 B2 2/2005 Osawa
2002/0045472 A1 4/2002 Adams
2002/0094855 A1 7/2002 Berman
2002/0198036 A1 12/2002 Baerlocher et al.
2003/0040360 A1* 2/2003 Kaminkow ..... 463/25
2003/0064772 A1 4/2003 Tempest et al.
2003/0064785 A1 4/2003 Stone et al.
2003/0069064 A1 4/2003 Ainsworth
2003/0207709 A1 11/2003 Paotrakul
2003/0207710 A1 11/2003 Rodgers et al.
2004/0029631 A1 2/2004 Duhamel
2004/0043815 A1 3/2004 Kaminkow
2004/0053673 A1 3/2004 Mishra
2004/0053683 A1 3/2004 Hartl et al.
2004/0072619 A1 4/2004 Brosnan et al.
2004/0152509 A1 8/2004 Hornik et al.
2004/0242315 A1 12/2004 Paulsen et al.
2005/0014554 A1 1/2005 Walker et al.
2005/0037838 A1 2/2005 Dunaevsky et al.
2007/0004505 A1* 1/2007 Walker et al. ..... 463/26

FOREIGN PATENT DOCUMENTS

EP 0 874 337 10/1998
EP 0 926 645 6/1999
EP 0 945 837 9/1999
EP 0 984 408 3/2000
EP 0 984 409 3/2000
GB 2 117 952 10/1983
GB 2 137 392 A 10/1984
GB 2 170 636 A 8/1986
GB 2 191 030 12/1987
GB 2 262 642 6/1993
GB 2353128 A 2/2001
GB 2393311 A 3/2004
WO WO 97/32285 9/1997
WO WO 00/12186 3/2000
WO WO 2004/078297 9/2004

OTHER PUBLICATIONS

4 Card Keno game Screens written by IGT, available prior to Aug. 17, 2005.
Bingo Game Brochure written by Casino Data System, published in 1998.
Elvis Brochure written by IGT, published in 1999.
Fortune Cookie Brochure written by IGT, published in 2000.
Full House Brochure written by Anchor Games, published in 2000.
Hot Reels Game Description by Silicon Gaming, available prior to Aug. 17, 2005.
Jackpot Bingo written by CDS.com, printed Apr. 12, 2001.

Jewel in the Crown Brochure written by Barcrest, Ltd, available prior to Aug. 17, 2005.
Little Devils Brochure written by IGT, published in 1998.
Match Reel Game Bonus Description written by IGT, available prior to Aug. 17, 2005.
Plinko Showcase Show Down written by IGT, published in 2001.
Slot Bingo Wagering Description and Paytable written by IGT, available prior to Aug. 17, 2005.
Slot Machines published by Reno-Tahoe Specialty, Inc. in 1989.
Slotopoly Brochure written by IGT, published in 1998.
Take Your Pick Brochure written by Anchor Games, published in 1999.
Tetris Game Description written by Radica, published in 2000.
Top Dollar Brochure written by IGT, published in 1999.
Totem Pole Advertisement written by IGT, published in 1997.
Triple Play Draw Poker Advertisement written by IGT, available prior to Aug. 17, 2005.
Tropical Fever Glass written by IGT, available prior to Aug. 17, 2005.
Wheel of Fortune Video Brochure published by IGT in 1999.
Winning Streak Brochure published by Aristocrat in 1994.
Slot Machines A Pictorial History of the First 100 Years (pp. 101-103, 150-157), 5th edition, written by Marshall Fey, published in 1983-1997.

* cited by examiner

GAMING DEVICE HAVING A COMPOSITE GAME WITH POTENTIAL AWARD-GENERATING GAME OR EVENT AND GUARANTEED AWARD-GENERATING GAME OR EVENT

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

The gaming industry is replete with games including slot games which are played one at a time. A typical game includes a primary or base game that produces an outcome. The outcome of the base game determines whether a player obtains an award from the base game and, in gaming machines which have more than one game, whether the player enters a secondary or bonus game. If the player advances to the bonus game, the bonus game produces an outcome and returns the player to the base game. The outcome in the bonus game is usually a win of some level.

Gaming devices having secondary or bonus games often employ a triggering event that occurs during the operation of the base game of the gaming device. As a result of reaching a predetermined outcome in the base game, the triggering event temporarily stalls or halts the play of the base game and enables a player to enter the bonus game. For example, in slot machines with reels, the triggering event can occur when the reels display a predetermined combination of symbols on the reels. The player plays the bonus game, likely receives an award, and returns to the base game.

Other known gaming devices have a bonus or secondary game that is played over the course of a number of plays of the primary or base game. These gaming devices, often referred to as persistence games, tend to award the player for a prolonged number of plays. In these games, each time the base game advances to the bonus game, a portion of the bonus game is played or at least one bonus game element is generated and the player returns to the base game. After the player has advanced to the bonus game a number of times (i.e., obtained a number of bonus game elements), an award is provided to the player.

There is a continuing need to provide new and different primary or base games and secondary or bonus games to entertain and provide enjoyment for players.

SUMMARY

The present application describes a gaming device and a method of operating a gaming device which includes a composite game having at least one potential award-generating game or event and at least one guaranteed award-generating game or event occurring in the composite game. In an embodiment, the composite game is a bonus or secondary game.

In an embodiment, the potential award-generating game or event can, but does not necessarily, provide an award to the player, and the guaranteed award-generating game or event provides or guarantees an award to the player. The potential award-generating game or event and the guaranteed award-generating game or event function as a composite game wherein, for each display and/or play of at least one potential award-generating game or event, at least one guaranteed award-generating game or event is displayed and/or played. In an embodiment, the potential award-generating game or event and the guaranteed award-generating game or event are sequentially displayed and played. In an embodiment, the potential award-generating game or event and the guaranteed award-generating game or event are simultaneously or at least partially displayed and played.

In an embodiment, at least one of the award-generating games or events of the composite game includes at least one terminating event. In an embodiment at least one, but not all, of the award-generating events includes at least one terminating event. In an embodiment, at least one, of the potential award-generating games or events of the composite game includes at least one terminating event. The potential award-generating game or event having a terminating event is simultaneously played along with at least one guaranteed award-generating game or event. In an embodiment, an award is provided to the player upon each occurrence of the potential award-generating event or play of the potential award-generating game unless a terminating event occurs. Alternatively, an award is not necessarily provided to the player upon each occurrence of the potential award-generating event or play of the potential award-generating game even if a terminating event does not occur. However, the composite game continues to be played until the terminating event in at least one award-generating game or event occurs. If the terminating event occurs, the composite game will end, and the award generated in the guaranteed award-generating game or event is provided to the player.

In an embodiment, each of the award-generating events occur as independent plays of a game. For example, in an embodiment, each of the award-generating events includes generating a winning combination of symbols associated with an award such as an activation of a set of reels in a game. Each of the independent plays of the game are simultaneously displayed to the player. The displayed independent events are simultaneously operated. An independent play of a guaranteed award-generating event can include activating a set of reels until a winning combination of symbols associated with an award is generated on the reels. An independent play of a potential award-generating event can include activating a set of reels until a combination of symbols is generated on the reels which may or may not result in a winning symbol or combination of symbols being generated. If a terminating event occurs in the potential award-generating event, such as the generation of a terminating symbol on the set of reels, each of the independent plays of the composite game ends.

In an embodiment, each award-generating event is an independent game in a composite game. Each of the plurality of independent games in the composite game are simultaneously displayed to the player. The displayed independent games are simultaneously operated. In one such embodiment, at least one of the independent games has a potential to provide an award, and at least one of the independent games provides a guaranteed award.

In an embodiment, the potential award-generating game includes an advancement game such as a trail or path game. The path game includes a plurality of adjacently arranged positions or segments. Awards such as values, or modifiers such as multipliers, are associated with a plurality of the positions. In an embodiment of the path game that includes a terminating event, the path game includes a terminator, such as a "collect" symbol, associated with at least one of the positions of the path.

In an embodiment of the path game, an indicator moves along the path of the interconnected positions for each play of the game. Movement along the path is defined by indicating a first or starting position and a second or ending position. Each of the first and second positions are determined by random or other generation. In an embodiment, the gaming device determines the second position by randomly generating and displaying a number of positions to advance the indicator along the path from the first position to the second position in a predetermined direction. One method of displaying a randomly generated number of positions includes simulating a roll of one or more dice. It should be appreciated that the present invention can include any suitable mechanism for randomly determining and displaying a number of positions an indicator advances along a path.

In an embodiment, an indicator begins at, or indicates, a first position on the path and advances one or more positions along the path based on the movement determination. If the indicator lands on a position associated with an award or modifier, the player is provided that award or modifier. In an embodiment, the total or composite bonus game payout is subsequently either increased by the value of the award or modified by the modifier. If the indicator lands on a position associated with a terminator or "Collect" symbol, the independent game does not provide an award or modifier, and the composite game ends after evaluating the other independent games. In an embodiment, if the indicator has not landed on a terminator symbol after a predetermined number of plays, or rolls of the dice, the independent game and the composite game automatically ends.

With each potential award-generating event occurring in a potential award-generating game, such as the path game, a guaranteed award-generating event simultaneously occurs in another independent game such as a selection game. The selection game includes a plurality of selections. An award, such as a value, or a modifier of an award, such as a multiplier, is associated with each of the selections. For each play of the game, the gaming device or the player picks a selection. The player is provided the award or modifier associated with the picked selection. In an embodiment, the selection game does not include a terminating event.

In an embodiment, the terminating event in the potential award-generating game terminates each of the independent games being played. For example, if the terminating event occurs in the path game, the player receives the award or modifier associated with the selection picked in the simultaneously played selection game, and each of the independent games of the composite game ends.

In an embodiment, an accumulation indicator such as an icon, symbol or other indicator is associated with at least one outcome of the game. If the outcome is achieved by the player, the indicator associated with the outcome is accumulated during play of the game. If the player achieves a predetermined number of accumulation indicators before a terminating event occurs in one of the games, the player is provided an additional award such as a progressive award. In an embodiment, accumulation of the predetermined number of indicators also acts to change the game, transition the player to a different level of the game or to terminate the game.

In one embodiment, at least one of the award-generating games or events of a composite game may be downloaded from at least one central processor remote from the gaming machine and may be controlled by the central processor or at least one local processor at the location of the gaming machine. In an embodiment, each of the guaranteed award-generating games or events, and each of the potential award-generating games or events are downloaded from a central processor to a local processor of the gaming machine where the play of the downloaded game is controlled by the local processor.

In one embodiment, at least one of the award-generating games or events of a composite game may be controlled by at least one local processor at the location of the gaming machine. In addition or alternatively, at least one of the award-generating games or events of a composite game may be controlled by at least one central processor remote from the gaming machine. In an embodiment, each of the guaranteed award-generating games or events, and each of the potential award-generating games or events is controlled by a local processor at the location of the gaming machine. In an embodiment, each of the guaranteed award-generating games or events, and each of the potential award-generating games or events is controlled by a central processor remote from the gaming machine.

In one embodiment, at least one of the award-generating games or events of a composite game is displayed by a mechanical display of the gaming machine. In addition or alternatively, at least one of the award-generating games or events of a composite game may be displayed by a video display of the gaming machine. In an embodiment, each of the guaranteed award-generating games or events, and each of the potential award-generating games or events are displayed by a mechanical display. In an embodiment, each of the guaranteed award-generating games or events, and each of the potential award-generating games or events are displayed by a video display.

An advantage of the present apparatus and method includes providing a combination of award-generating opportunities which simultaneously provide awards to a player.

Another advantage of the present apparatus and method includes combining multiple independent games or plays of a game that insure an award to be provided to a player in at least one of the games or plays of a game.

Another advantage of the present apparatus and method includes not diminishing the odds of winning a progressive award by the advancement of a symbol along a path in a path game.

Additional features and advantages of the present apparatus and method are described in, and will be apparent from, the following Detailed Description and the Figures.

DETAILED DESCRIPTION OF THE INVENTION

The Gaming Device Generally

Figure 1A:
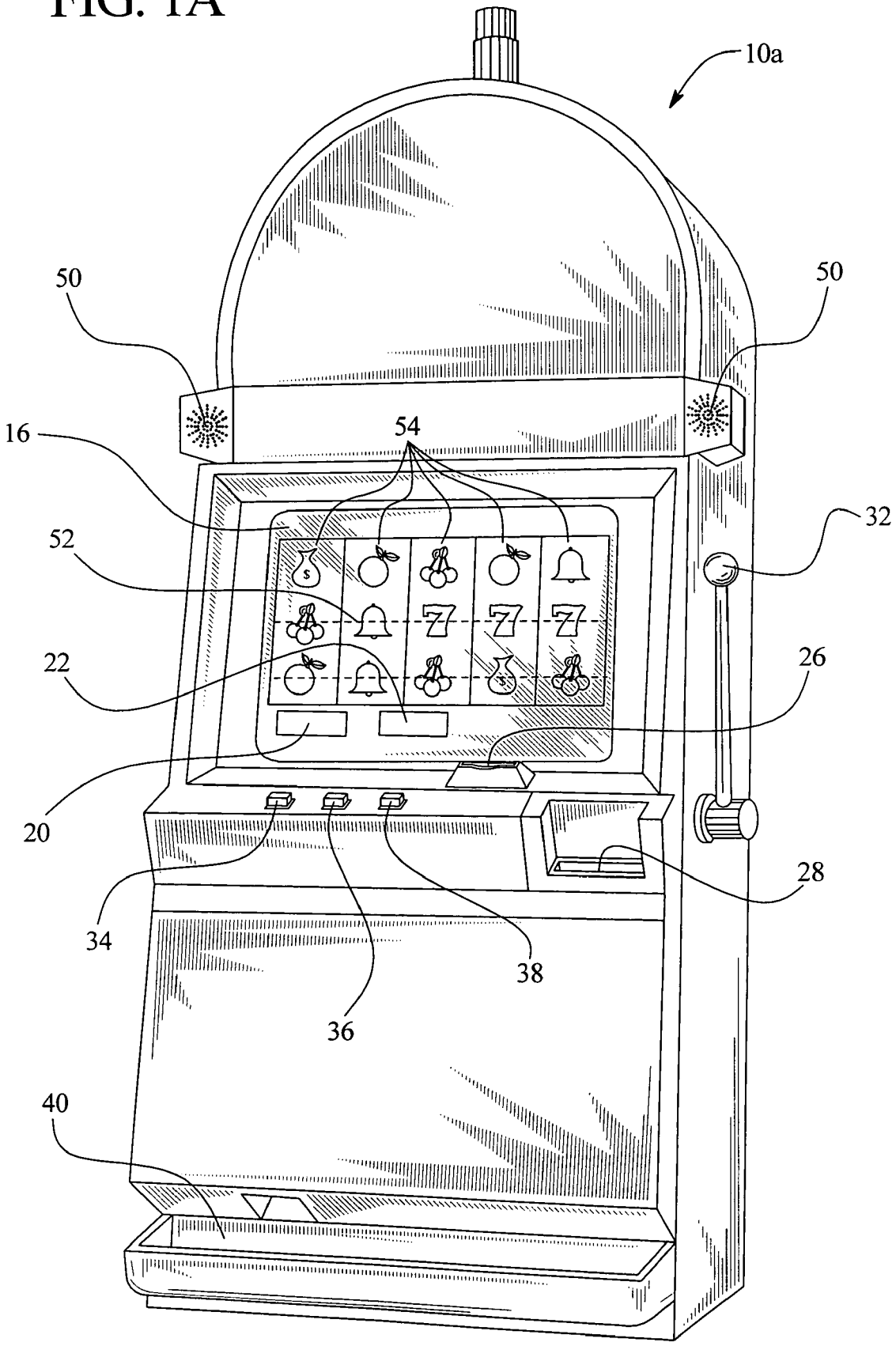
FIGS. 1A and 1B are front perspective views of various embodiments of a slot machine embodiment of a gaming device.
Figure 1B:
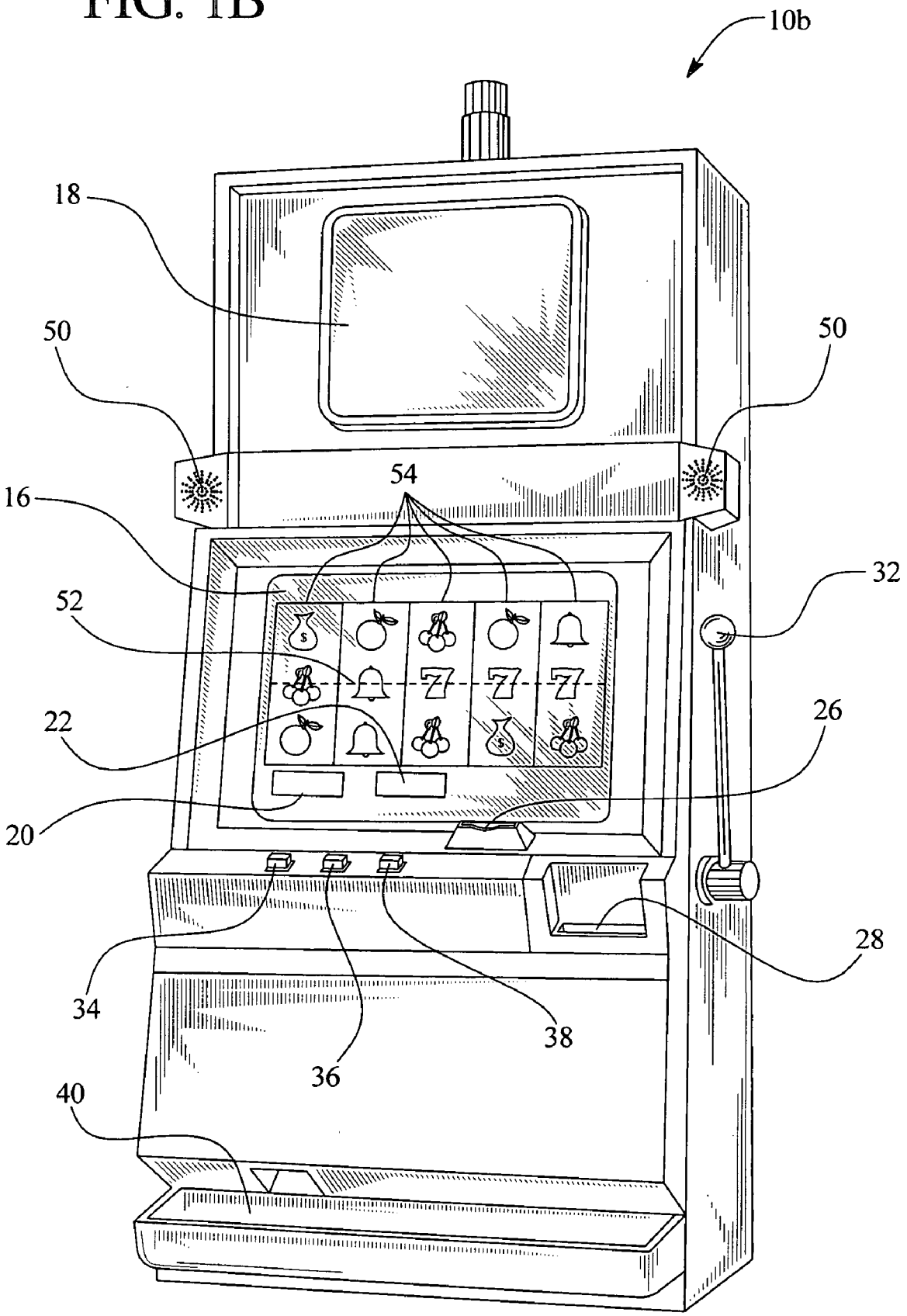

Referring now to the drawings, two alternative embodiments of the gaming device are illustrated in FIGS. 1A and 1B as gaming device 10*a* and gaming device 10*b*, respectively.

Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
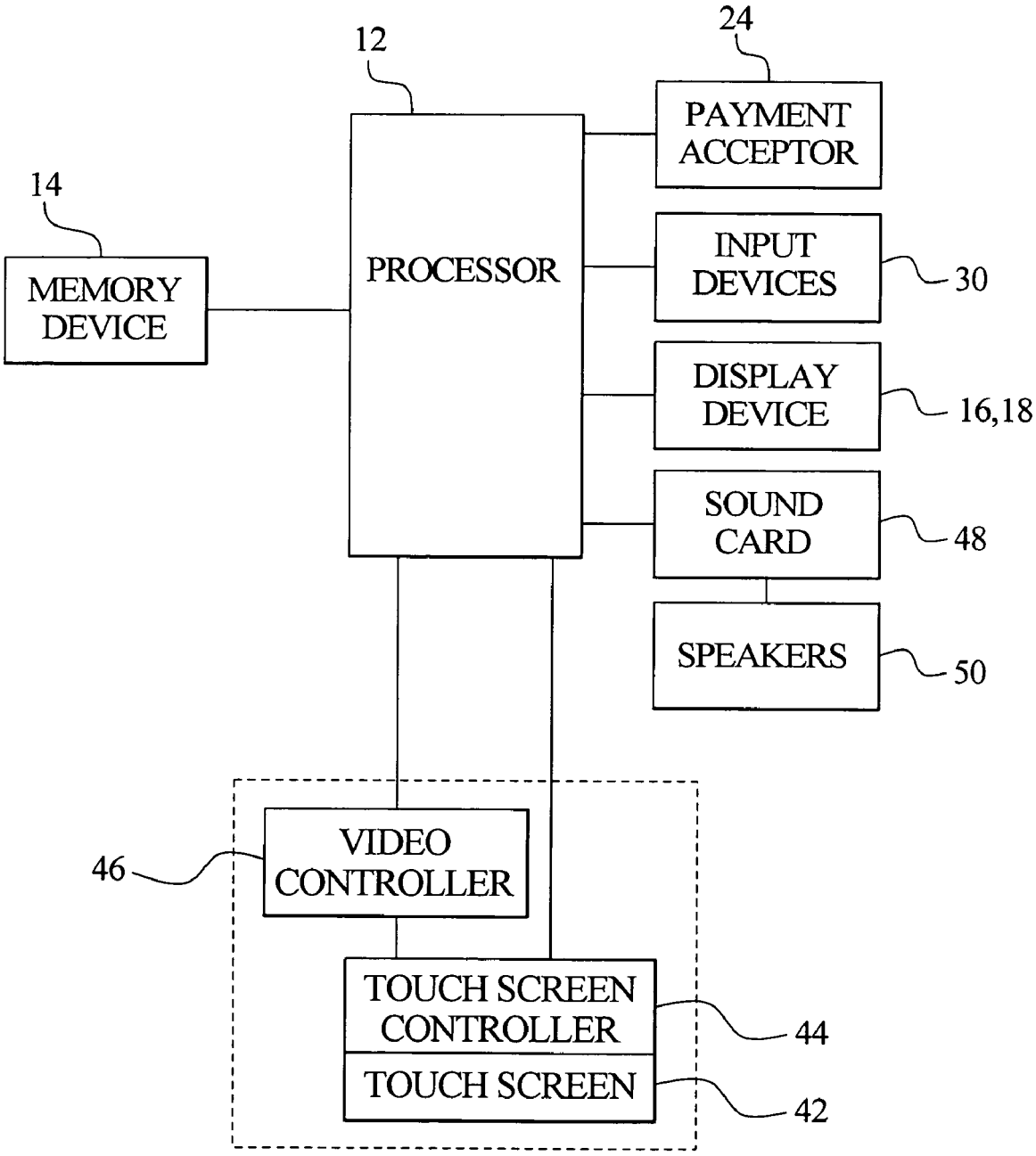
FIG. 2A is a schematic block diagram of the electronic configuration of one embodiment of a gaming device.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the art. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome. Such random determination could be provided through utilization of a random number generator (RNG) or other suitable randomization process.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses. In another embodiment, upon a player initiating game play at the gaming device, the gaming device enrolls in a bingo game. In this embodiment, a bingo server calls the bingo balls that result in a specific game outcome. The resultant game outcome is communicated to the individual gaming device to be provided to a player.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. In another embodiment, at least one display device may be a mobile display device, such as a PDA or tablet PC, that enables play of at least a portion of the primary or secondary game at a location remote from the gaming device. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display including a projected and/or reflected image or any other suitable electronic device or display mechanism. In one embodiment, as described in more detail below, the display device includes a touch-screen with an associated touch-screen controller. The display devices may be of any suitable configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video Keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device displays at least one and preferably a plurality of reels 54, such as three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, one or more of the display devices, as described above, display the plurality of simulated video reels 54. Each reel 54 displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active payline or otherwise occur in a winning pattern, occur on the requisite number of adjacent reels and/or occur in a scatter pay arrangement.

In one embodiment, a base or primary game may be a poker game wherein the gaming device enables the player to play a conventional game of video poker and initially deals five cards all face up from a virtual deck of fifty-two card deck.

Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one and preferable a plurality of the selectable indicia or numbers via an input device or via the touch screen. The gaming device then displays a series of drawn numbers to determine an amount of matches, if any, between the player's selected numbers and the gaming device's drawn numbers. The player is provided an award based on the amount of matches, if any, based on the amount of determined matches.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game could be accomplished through a simple "buy in" by the player if, for example, the player has been unsuccessful at qualifying through other specified activities.

Figure 2B:
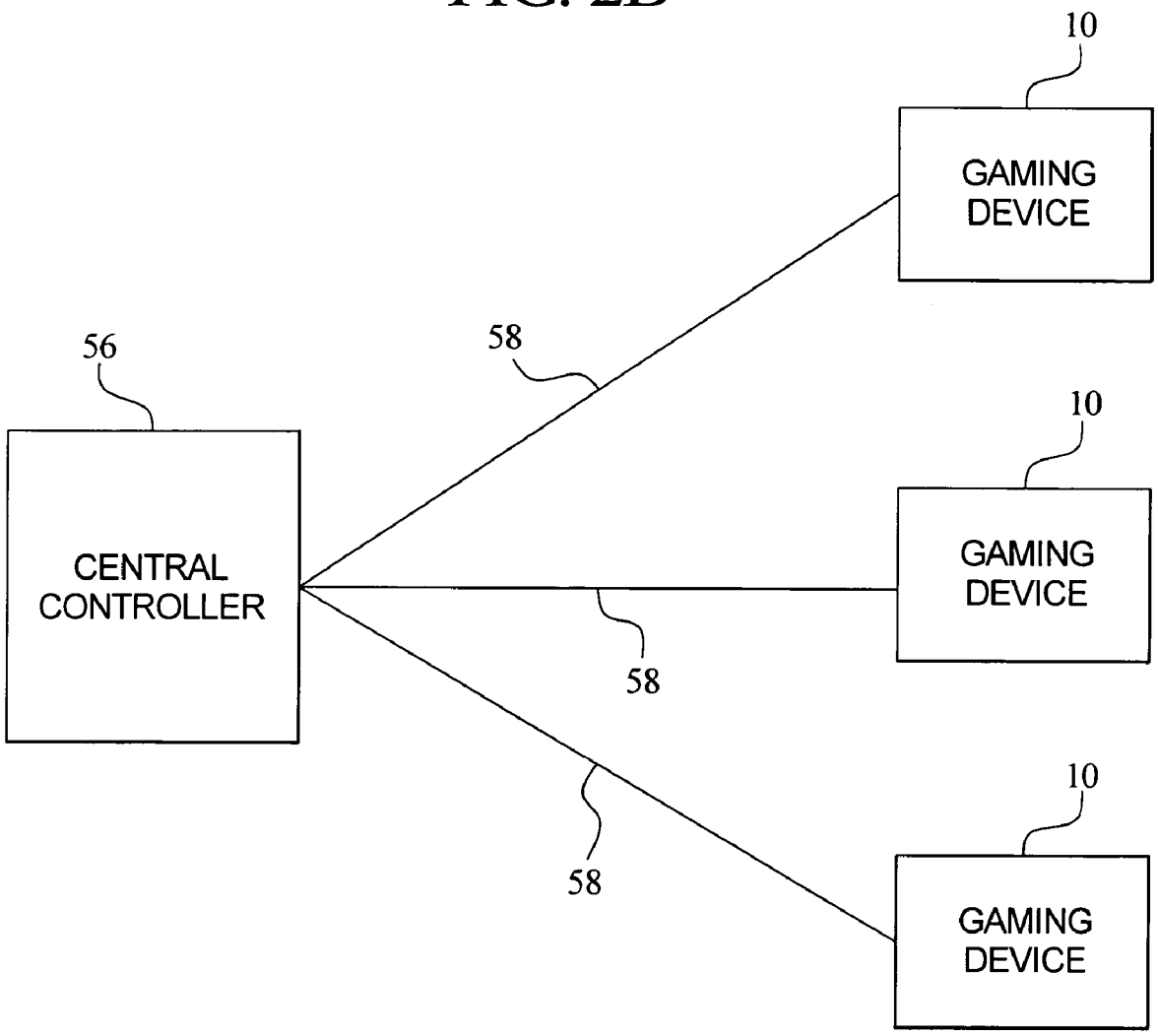
FIG. 2B is a schematic block diagram of various gaming devices are networked to a central controller.

In one embodiment, as illustrated in FIG. 2B, one or more of the gaming devices 10 may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo or keno game. In this embodiment, each individual gaming device utilizes one or more bingo or keno games to determine the predetermined game outcome value provided to the player for the interactive game played at that gaming device. In one embodiment, the bingo or keno game is displayed to the player. In another embodiment, the bingo or keno game is not displayed to the player, but the results of the bingo or keno game determine the predetermined game outcome value for the interactive game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a "daub" button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment insures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

In another embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a "chip" to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer. In one embodiment, an individual gaming machine may trigger a progressive win, for example through a game play event such as a symbol-driven trigger. In one embodiment, the central server or other central controller determines when a progressive win is triggered. In one embodiment, a central controller and an individual gaming machine work in conjunction with each other to determine when a progressive win is triggered, for example through an individual gaming machine meeting a predetermined requirement established by the central controller.

Award-Generating Game Embodiment

The gaming device and method of operating a gaming device disclosed herein include a composite game having a plurality of award-generating events or games including at least one guaranteed award-generating event or game and at least one potential award-generating game or event. For each display and play of at least one guaranteed award-generating game or event at least one potential award-generating game or event is played and displayed to the player. Each of the award-generating events or games are sequentially, simultaneously, or partially simultaneously displayed, and each of the award-generating events or games are sequentially or simultaneously played to provide the player at least one award.

In an embodiment, each of the award generating games of the composite game are controlled by a central controller or processor 56 remote from the gaming machine. It should be appreciated that at least one of the guaranteed award-generating games or events and/or at least one of the potential award-generating games or events can be controlled by at least one central processor 56. In addition, or alternatively, at least one of the guaranteed award-generating games or events and/or at least one of the potential award-generating games or events can be controlled by at least one local processor 12 at the location of the gaming machine.

In an embodiment, each of the guaranteed award-generating games or events, and each of the potential award-generating games or events are downloaded from a central processor 56 to the local processor 12 of the gaming machine where the play of the downloaded games is controlled by the local processor 12. It should be appreciated that at least one of the award-generating games or events of a composite game can be downloaded from at least one central processor 56 remote from the gaming machine to at least one local processor 12 at the location of the gaming machine. It should be further appreciated that the downloaded game or games can be controlled by the central processor and/or the local processor as described above.

Figure 3A:
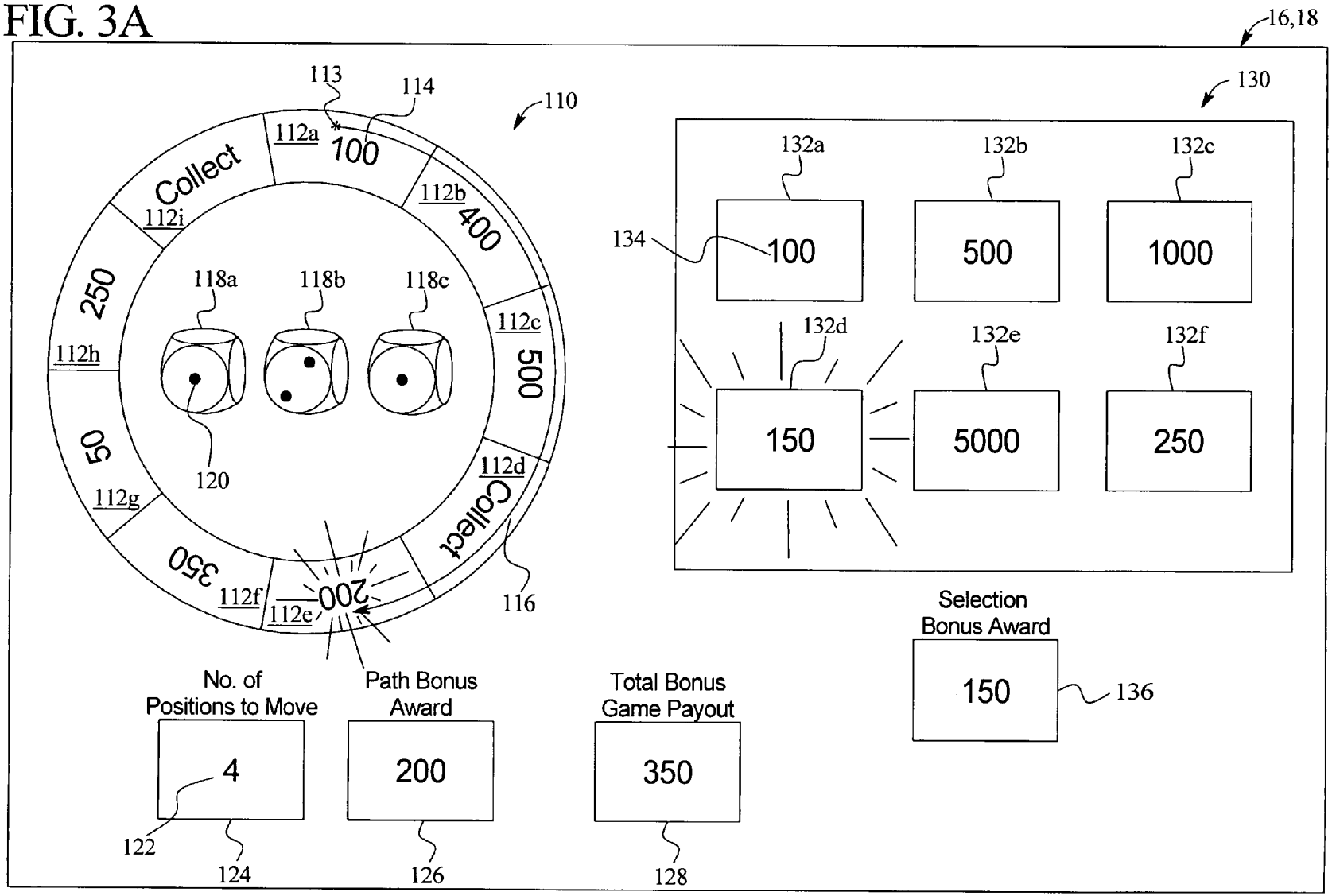
FIGS. 3A, 3B and 3C are elevation views of a display device showing one embodiment of the game device.
Figure 3B:
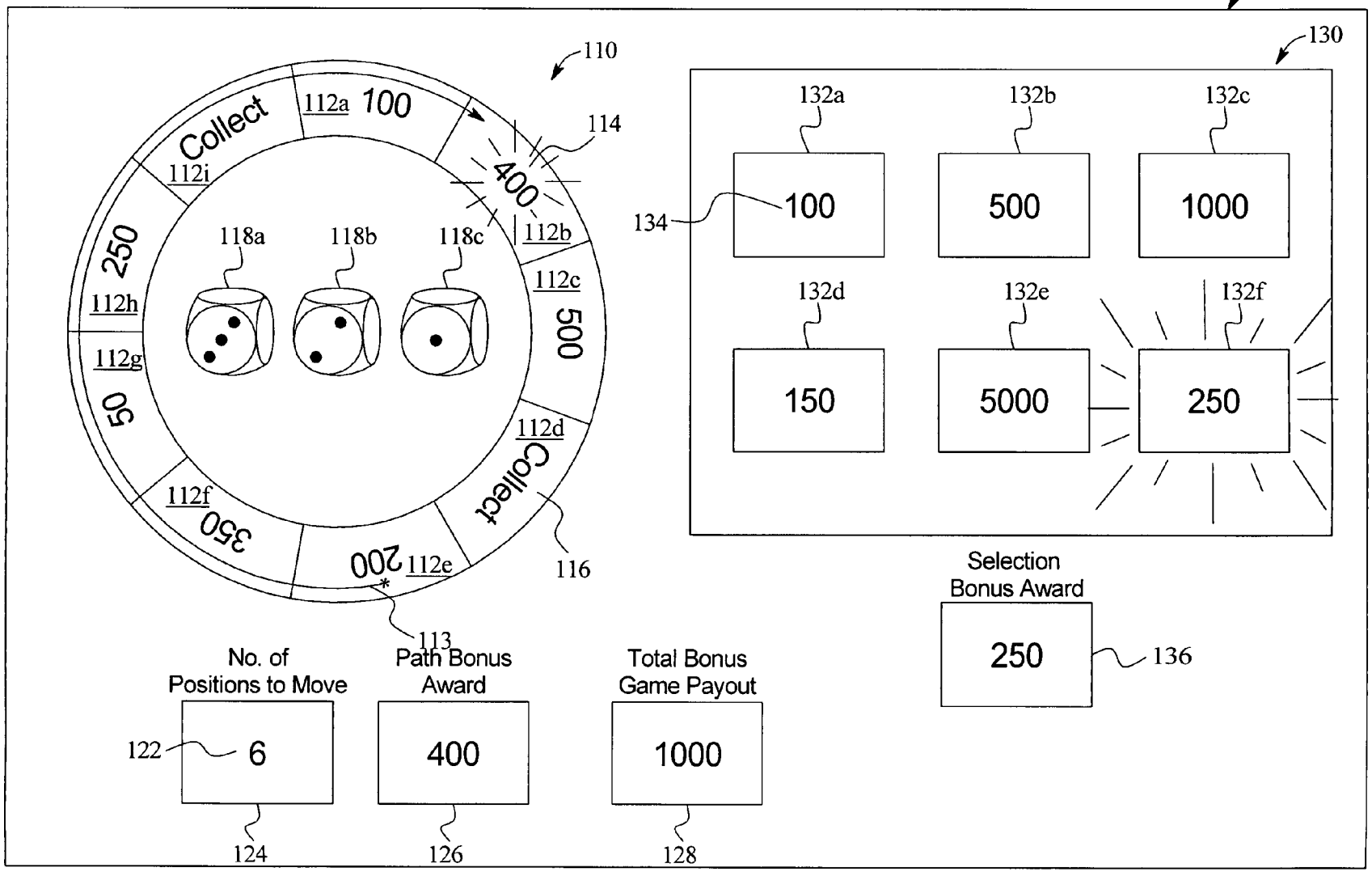
Figure 3C:
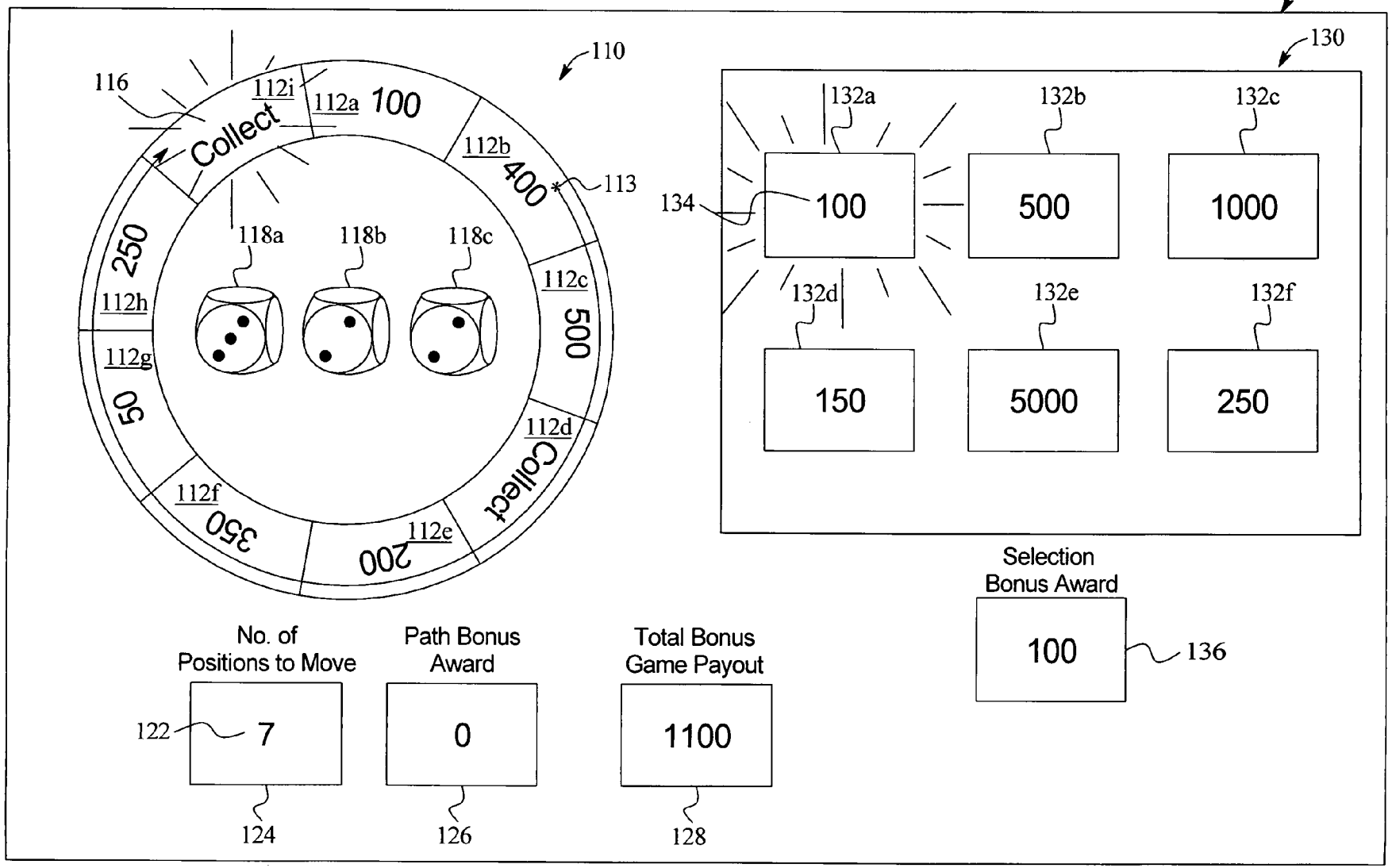

Referring now to FIGS. 3A, 3B and 3C, in an embodiment of the present invention, the composite game includes two independent award-generating games including one potential award-generating game and one guaranteed award-generating game. In this illustrated embodiment, the potential award-generating game includes a terminating condition or event, but the guaranteed award-generating game does not include a terminating event in this illustrated embodiment. The potential award-generating game illustrated in FIG. 3A, includes an advancement game such as a trail or path game 110. The path game 110 includes a plurality of segments or positions 112*a*, 112*b*, 112*c*, 112*d*, 112*e*, 112*f*, 112*g*, 112*h*, and 112*i*. The positions of a path game are adjacently arranged and sequentially interconnected. In the embodiment illustrated in FIG. 3A, the positions 112 are arranged in a circular shape. It should be appreciated, however, that any suitable number of positions can be included in a path game and that the positions can be arranged in any suitable linear or non-linear pattern.

In an embodiment, awards or modifiers are associated with a plurality of the positions. As illustrated in FIG. 3A, values of awards 114 are associated with multiple positions 112 in the path game 110. It should be appreciated that any symbol or indicia representing an award or modifier of an award, in whole or in part, can be associated with the positions of the path game. In FIG. 3A, a value of one hundred is associated with position 112*a*, a value of four hundred is associated with position 112*b*, a value of five hundred is associated with position 112*c*, a value of two hundred is associated with position 112*e*, a value of three hundred fifty is associated with position 112*f*, a value of fifty is associated with position 112*g*, and a value of two hundred fifty is associated with position 112*h*. It should be appreciated that any suitable value or other outcome can be associated with any of the positions.

The path game includes a terminating event in this embodiment such as a collect or terminator symbol 116 associated with at least one position. For example, in FIG. 3A, the word "Collect" is associated with positions 112*d* and 112*i*.

In an embodiment, movement along the trail or path of an advancement game is defined by initially indicating a first or starting position and then a second or ending position after a random determination. In FIG. 3A, position 112*a* is indicated as a first position by an indicator 113, and position 112*e* is indicated as a second position.

Each of the first and second positions can be randomly determined. In an embodiment, the second position is determined by randomly generating a number of positions from the first position to the second position in a predetermined direction. The embodiment illustrated in FIGS. 3A to 3C, employs a plurality of dice to display the number of positions 112 (from the first position 112*a*) that is randomly generated by the gaming device 10. As illustrated in FIG. 3A, three dice 118*a*, 118*b* and 118*c* are operable to display the number of positions 112 the indicator 113 advances in a play of the game. The number of spots 120 on the dice 122 can be displayed in any suitable combination to add up to the number of positions 112 generated by the gaming device. For example, in FIG. 3A, die 118*a* displays one spot, die 118*b* displays two spots and die 118*c* displays one spot. Therefore, the dice 118 display a total of four spots 120 indicating that movement of the indicator 113 to a second position is four positions 122 from the first position 112*a*, as indicated by the Number of Positions to Move display 124. Accordingly, the indicator 113 indicates movement from the first position 112*a* through positions 112*b*, 112*c* and 112*d*, respectively to the second position 112*e*. It should be appreciated that, in this embodiment, the minimum number of positions to be moved from the first position is at least three since at least one spot must be displayed on each of the three die. It should also be appreciated that any suitable method of randomly determining the number of positions an indicator advances along the path and any suitable method of displaying that number of positions can be used in accordance with the present invention.

If the indicator 113 lands on a position associated with a value, the player is provided that value. The value of the award 114 associated with the indicated position 112*e* in FIG. 3A is two hundred. Therefore, two hundred credits is provided to the player as indicated in a Path Bonus Award display 126. The value of two hundred credits is also added to a Total Bonus Game Payout display 128.

In an embodiment, each of the two independent award-generating games of the composite game are displayed by a video display of the gaming machine. It should be appreciated, however, that at least one of the independent award-generating games can be displayed by a mechanical display of the gaming machine, a video display of the gaming machine or any combination thereof.

In an embodiment, each of the two independent award-generating games of the composite game are displayed and played simultaneously or partially simultaneously. In other words, the guaranteed award-generating game is simultaneously or partially simultaneously displayed on the same or different display devices along with the potential award-generating game, such as the path game 110 described above. It should be appreciated, however, that each of the two independent award-generating games of the composite game can be displayed sequentially.

In FIGS. 3A to 3C, the guaranteed award-generating game is simultaneously or partially simultaneously played along with the potential award-generating game. It should be appreciated, however, that each of the two independent award-generating games of the composite game can be played sequentially. In the embodiment illustrated in FIGS. 3A to 3C, the guaranteed award-generating game is a selection game 130. The selection game 130 illustrated in FIG. 3A includes a plurality of selections including selections 132*a*, 132*b*, 132*c*, 132*d*, 132*e* and 132*f*. A plurality of awards or payouts are associated with the selections such that each selection includes one award. In the embodiment illustrated in FIG. 3A, the selections include values 134 or a number of credits to be provided to the player upon selection of the award. For example, a value of one hundred is associated with selection 132*a*, a value of five hundred is associated with selection 132*b*, a value of one thousand is associated with selection 132*c*, a value of one hundred fifty is associated with selection 132*d*, a value of five thousand is associated with selection 132*e*, and a value of two hundred fifty is associated with selection 132*f*. It should be appreciated that the selections can include any suitable outcome such as an award, part of an award or a modifier of an award. It should also be appreciated that the awards or modifiers associated with each of the selections can be hidden from view or masked from the player until the selection is picked. In such an embodiment, the player can be enabled to pick at least one of the selections. In the illustrated embodiment, the values associated with the selections are revealed to the player before a selection is randomly picked by the gaming device.

For each play of the game, the gaming device in the selection game randomly picks one of the selections and provides the value associated with the picked selection to the player. As illustrated in FIG. 3A, the selection 132*d* associated with an award of one hundred fifty is randomly picked by the gaming device 10 and is indicated in a Selection Bonus Award display 136. The one hundred fifty credits generated in the selection game 130 is then added to the two hundred credits generated in the path game 110 for a total bonus game payout of three hundred fifty credits from a single play of the game as indicted in the Total Bonus Game Payout display 128. Therefore, in an embodiment, the player may receive an award from each of the guaranteed award-generating games as long as a terminating event does not occur in at least one of the award-generating games.

After the player is provided any value associated with the player's position and/or the value associated with the selections, the indicator is advanced to another position along the path, and another selection is simultaneously picked. This process continues until the player lands on a position associated with a collect or terminate symbol, thereby terminating the game. FIGS. 3B and 3C illustrate further simultaneous play of each of the independent games 110 and 130. In FIG. 3B, position 112*e* is indicated as a first position. The dice 118 display a combination of six spots 120 indicating a movement to a second position 112*b* that is six positions 122 from the first position 112*e*, as indicated in the Number of Positions to Move display 124. Accordingly, the indicator 113 indicates movement from the first position 112*e* through positions 112*f*, 112*g*, 112*h*, 112*i* and 112*a*, respectively, to the second position 112*b*. The value 114 associated with the indicated position 112*b* is four hundred credits which is displayed in the Path Bonus Award display 126.

Simultaneously, selection 132*f* associated with a value 134 of two hundred fifty is randomly picked in the selection game 130 and displayed in the Selection Bonus Award display 136. The two hundred fifty credits generated in the selection game 130 is then added to the four hundred credits generated in the path game 110 and the previous total bonus game payout of three hundred fifty credits for a total bonus game payout 128 of one thousand credits as indicated in the Total Bonus Game Payout display 128.

In FIG. 3C, position 112*b* is now indicated as a first position. The dice 118 display a combination of seven spots 120 indicating a movement to a second position that is seven positions 122 from the first position as indicated in the Number of Positions to Move display 124. Accordingly, the indicator 113 indicates movement from the first position 112*b* through positions 112*c*, 112*d*, 112*e*, 112*f*, 112*g* and 112*h*, respectively, to the second position 112*i*. In this play of the path game 110, the word "Collect" 116 is associated with position 112*i* which acts as a terminating event in the game. As indicated in the Path Bonus Award display 126, no award is provided to the player for this play of the path game 110 because no value is associated with the indicated position 112*i* to which the player is advanced.

Simultaneously, selection 132*a* associated with a value 134 of one hundred is randomly picked in the selection game 130 and displayed in the Selection Bonus Award display 136. The one hundred credits generated in the selection game 130 is then added to the previous total bonus game payout of one thousand credits for a total bonus game payout of one thousand one hundred credits as indicated in the total bonus game payout display 128. Therefore, although a terminating event occurs in the path game 110, the player still receives an award from the simultaneously played selection game 130.

Independent Game with Accumulator Embodiment

Figure 4A:
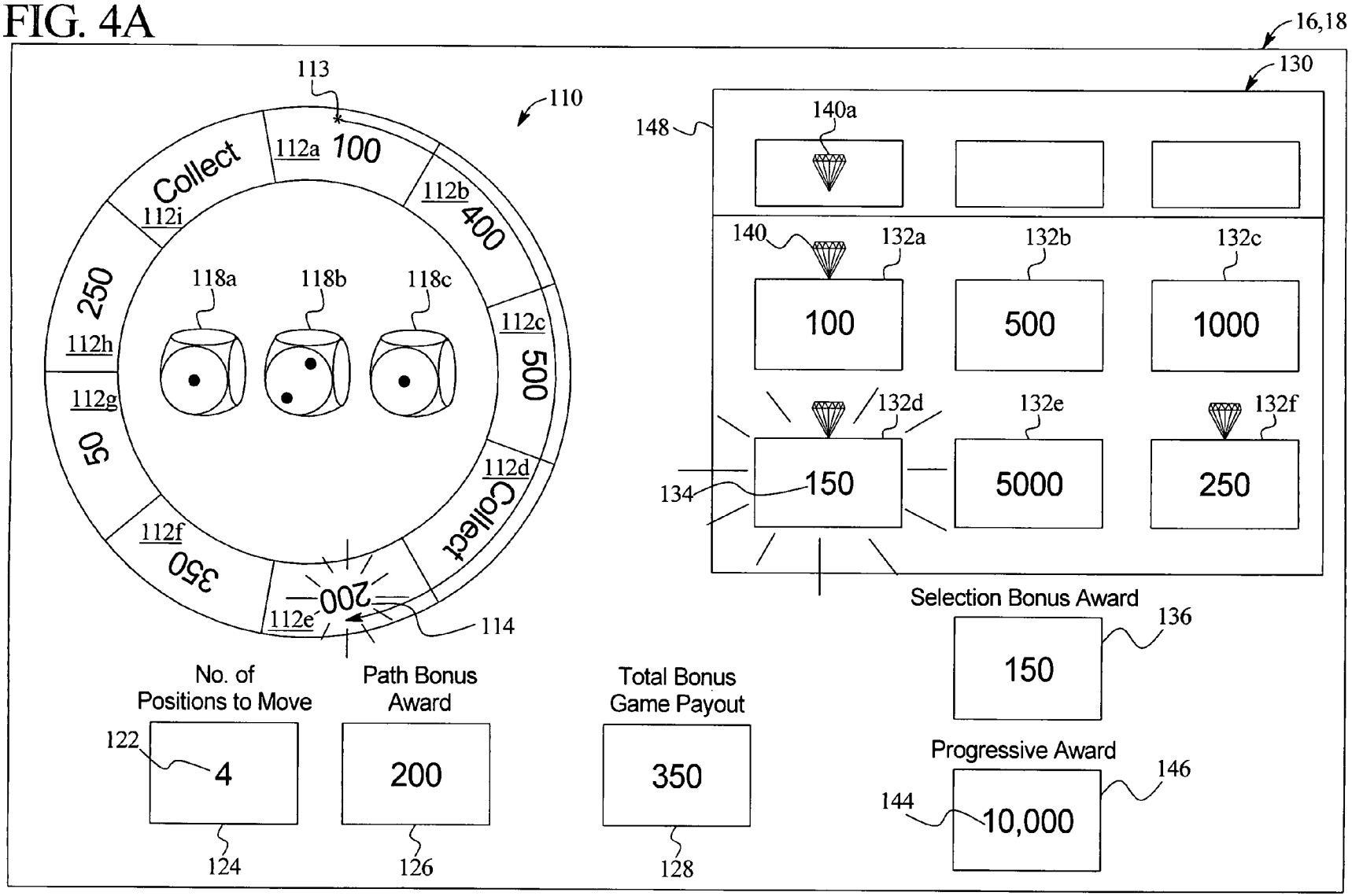
FIGS. 4A, 4B and 4C are elevation views of a display device showing an alternative embodiment of the gaming device.
Figure 4B:
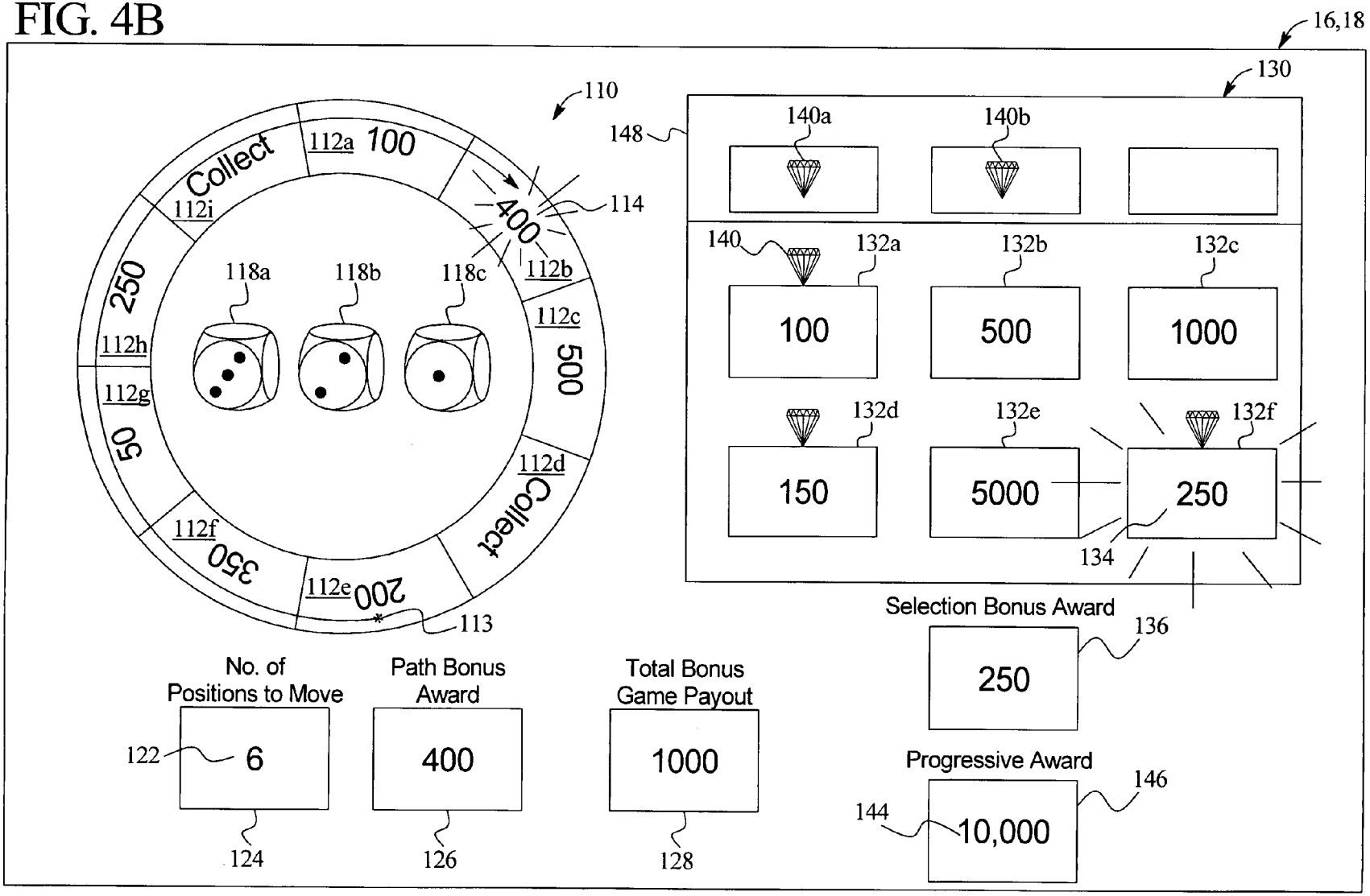
Figure 4C:
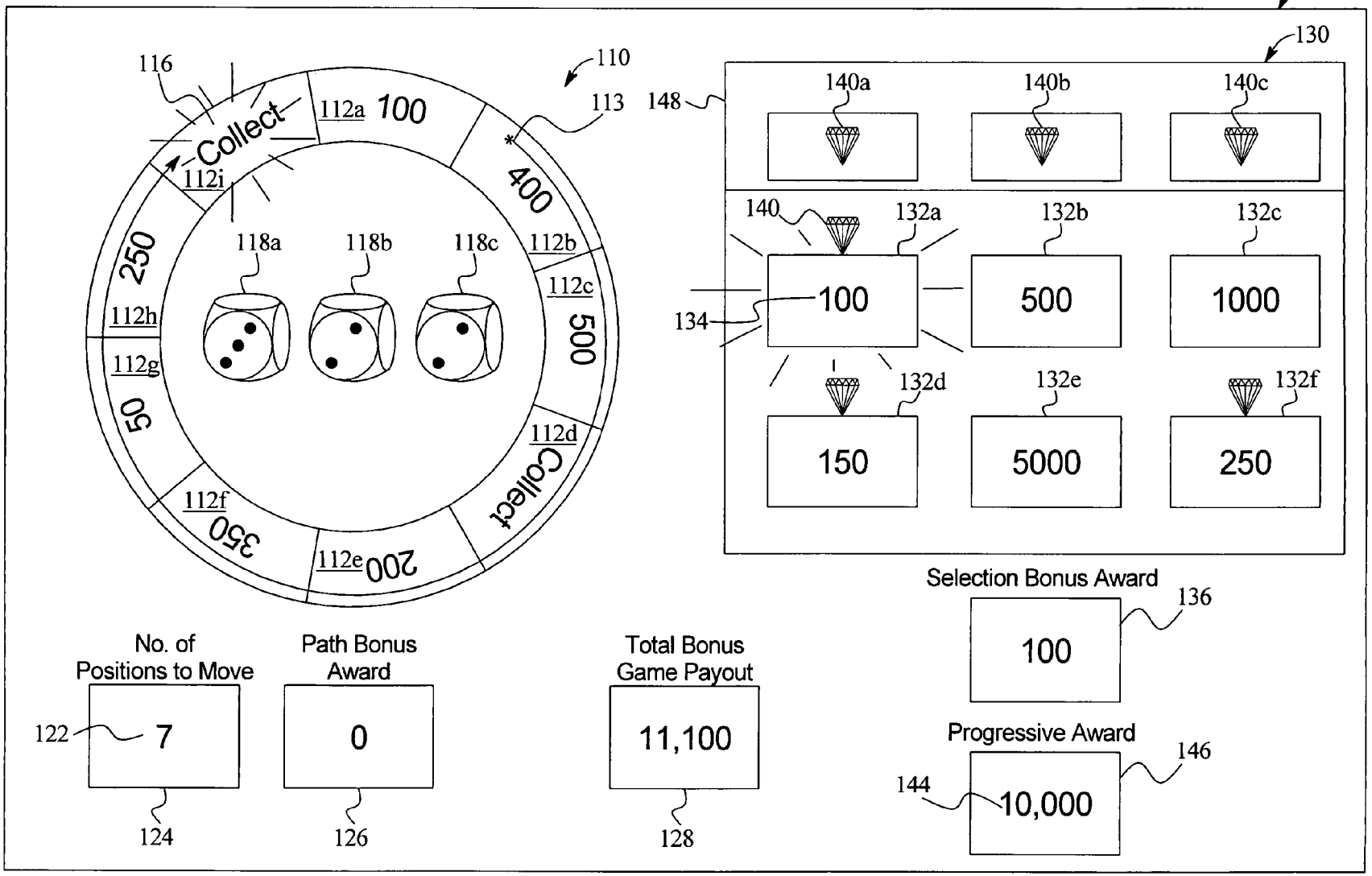

In an embodiment of the present invention illustrated in FIGS. 4A to 4C, the composite game includes at least one accumulation indicator, such as a "jewel" symbol. The accumulation indicator is associated with at least one of the awards in at least one of the award-generating games such as the selection game. If a predetermined number of picked selections includes an accumulation indicator, the player is provided a progressive award.

As illustrated in FIG. 4A, an accumulation indicator is represented by a jewel 140 that is associated with selections 132*a*, 132*d* and 132*f* of the guaranteed award-generating selection game. A progressive award 144 of ten thousand credits is displayed in the Progressive Award display 146. It should be appreciated that the progressive award can be predetermined or accumulated over a series of games. Furthermore, the progressive award can be generated in at least one previously played game, in the primary game or in another independent game of the composite game. If a predetermined number of jewels 140, such as three, are accumulated before a terminating event occurs in the path game 110 for example, the player is provided the progressive award 144.

Play in the path game 110 and selection game 130 occurs as illustrated in FIGS. 3A to 3C and as described above. In the selection game 130, however, if the selection 132 includes an associated jewel 140, the jewel 140 is accumulated in an accumulation display 148. In FIG. 4A, the randomly picked selection 132*d* is associated with a value 134 of one hundred fifty and is also associated with a jewel 140. Accordingly, a jewel 140*a* is displayed in the accumulator display 148.

During play of the composite game, an accumulator (not shown) counts the number of jewels 140 associated with the awards 134 provided to the player in each play of the composite game. Hence, in FIG. 4B, when the randomly picked selection 132*f* associated with a value 134 of two hundred fifty is also associated with a jewel 140, a second jewel 140*b* is displayed in the accumulator display 148.

In FIG. 4C, although the player is not provided an award in the path game 110, the randomly picked selection 132*a* in the selection game is associated with a value of one hundred and a jewel 140. The jewel 140 is accumulated and displayed in the accumulator display 148. In the embodiment illustrated in FIG. 4C, the progressive award 144 is provided to the player if the predetermined number of three jewels 140 is accumulated. Therefore, in FIG. 4C, the third jewel 140*c* of the predetermined number of three jewels is accumulated, and the player is provided the progressive award 144 of ten thousand credits. Ten thousand credits is added to the one thousand one hundred credits already provided to the player in the current selection game 130 and the preceding plays of the selection game 130 and the path game 110. The total bonus game payout, therefore, is eleven thousand one hundred as indicated by the Total Bonus Game Payout display 128.

It should be appreciated that a terminating event can be associated with the selection game 130. For example, in an embodiment, the composite game ends if a predetermined number of accumulation indicators is accumulated in the selection game 130. In addition, it should be appreciated that other variations can occur in the number of and types of award-generating events or games that are combined in the composite game of the present invention. It should be further appreciated that the composite game of the present invention can be a base or primary game or a bonus or secondary game.

It should be appreciated that the award-generating events of the present invention can include independent award-generating events of the same game. For example, in an embodiment, the game can include simultaneous activations of a plurality of sets of reels to generate on each set of reels a winning combination of symbols associated with an award. At least one of the independent award-generating events includes a guaranteed award-generating event. The guaranteed award-generating event can include activating a set of reels until a winning combination of symbols associated with an award is generated on the reels. At least one of the independent award-generating events includes a potential award-generating event. The potential award-generating event can include activating a set of reels until a combination of symbols is generated on the reels which may or may not include a winning symbol or combination of symbols. If a terminating event occurs in at least one of the award-generating events, such as the generation of a terminating symbol on the set of reels, each of the reel activations can end, and the game ends.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

at least one input device;

at least one display device;

at least one processor; and at least one memory device which stores a plurality of instructions, which when executed by the at least one processor, cause the at least one processor to operate with the at least one input device and the at least one display device, for each and every play of a composite game, to:

(i) cause a display of said play of said composite game which includes:

(1) causing a display of at least one play of a potential award-generating game; and (2) additionally and distinctly from the play of the potential award generating game, causing a display of at least one play of a guaranteed award-generating game, wherein for each and every play of the potential award-generating game, at least one play of the guaranteed award-generating game occurs, (ii) for each play of the guaranteed award-generating game:

(1) display a randomly determined outcome from a plurality of different outcomes, the outcomes including a display of a plurality of symbols, and (2) based upon the displayed randomly determined outcome, determine one of a plurality of monetary guaranteed awards to provide to a player, (iii) in addition to randomly determining any monetary guaranteed award from each play of the guaranteed award-generating game and separate from any random determination of any monetary guaranteed awards, for each play of the potential award generating game, determine if any award is generated for said play of the potential award-generating game wherein, said award for said play of the potential award-generating game may or may not be generated, and (iv) provide to the player all of said randomly determined monetary guaranteed awards generated from each play of the guaranteed award-generating game and any of said awards generated from each play of the potential award generating game of said play of the composite game.

2. The gaming device of claim 1, wherein the composite game is a bonus game.

3. The gaming device of claim 1, wherein the composite game is a base game operable upon a wager.

4. The gaming device of claim 1, wherein at least one of the award-generating games include at least one terminating event.

5. The gaming device of claim 1, wherein the composite game includes a plurality of potential award-generating games.

6. The gaming device of claim 1, wherein the composite game includes a plurality of guaranteed award-generating games.

7. The gaming device of claim 1, wherein, when executed by the at least one processor, the plurality of instructions cause the at least one processor to operate with the at least one display device to display the potential award-generating game and the guaranteed award-generating game simultaneously, or at least partially simultaneously.

8. The gaming device of claim 1, wherein at least one play of the potential award-generating game and at least one play of the guaranteed award-generating game occur simultaneously or at least partially simultaneously.

9. The gaming device of claim 1, wherein, when executed by the at least one processor, the plurality of instructions cause the at least one processor to provide an additional award to the player if a predetermined outcome is achieved by the player in at least one of the award-generating games.

10. The gaming device of claim 9, wherein the additional award includes a progressive award.

11. The gaming device of claim 1, wherein the award-generating game includes a path game, said path game including a plurality of adjacently interconnected positions wherein an indicator is moved from a first position to a second position of said plurality of positions and wherein the player is provided an outcome associated with the indicated second position.

12. The gaming device of claim 11, wherein the path game includes a terminating event, wherein said terminating event includes indicating a second position having a terminating symbol associated with said second position.

13. The gaming device of claim 11, wherein the number of positions moved by the indicator from a first position to a second position is randomly determined.

14. The gaming device of claim 1, wherein the guaranteed award-generating game includes a selection game, wherein an award provided to the player is based on a symbol associated with a picked selection.

15. The gaming device of claim 1, which includes at least one of the configurations selected from the group consisting of:

a) said at least one processor including at least one central processor remote from the gaming device;

b) said at least one processor including at least one central processor remote from the gaming device, wherein the central processor controls at least one of the award-generating games;

c) wherein the at least one processor is configured to receive at least one award-generating game downloaded from a central processor;

d) wherein the at least one processor is configured to receive each of the guaranteed award-generating games downloaded from the central processor;

e) wherein the at least one processor is configured to receive each of the potential award-generating games downloaded from the central processor; and f) wherein the at least one processor is configured to receive at least one award-generating game downloaded from the central processor and wherein the award-generating game downloaded from the central processor is controlled by the central processor.

16. The gaming device of claim 1, wherein the display device is selected from the group consisting of at least one mechanical display device, at least one video display device, and combinations thereof.

17. A method of operating a gaming device, said method comprising for each and every play of a composite game:

(i) causing at least one processor to operate with one display device to display said composite game, including:

(a) displaying at least One play of a potential award-generating game, and (b) additionally and distinctly from the play of the potential award-generating game, displaying at least one play of a guaranteed award-generating game wherein, for each and every play of the potential award-generating game, at least one play of the guaranteed award-generating game occurs;

(ii) for each play of the guaranteed award-generating game causing the at least one processor to operate with the at least one display device to:

(a) display a randomly determined outcome from a plurality of different outcomes, the outcomes including a display of a plurality of symbols, and (b) based upon the displayed randomly determined outcome, determine one of a plurality of monetary guaranteed awards to provide to a player;

(iii) causing the at least one processor, in addition to randomly determining any guaranteed award from each play of the guaranteed award generating game and separate from any random determination of any monetary guaranteed awards, for each play of the potential award-generating game, to separately determine if any award is generated for said play of the potential award-generating game wherein, said award for said play of the potential award-generating game may or may not be generated; and (iv) causing the at least one processor to provide to the player all of said randomly determined monetary guaranteed awards generated from each play of the guaranteed award-generating game and all of said random awards generated from each play of the potential award-generating game of said play of the composite game.

18. The method of claim 17, which includes associating a terminating event with at least one of the award-generating games.

19. The method of claim 17, wherein the composite game includes a plurality of potential award-generating games.

20. The method of claim 17, wherein the composite game includes a plurality of guaranteed award-generating games.

21. The method of claim 17, which includes simultaneously or at least partially simultaneously causing the at least one display device to display the potential award-generating game and the guaranteed award-generating game.

22. The method of claim 17, which includes simultaneously or at least partially simultaneously causing play of the potential award-generating game and the guaranteed award-generating game.

23. The method of claim 17 which includes providing an additional award to the player if a predetermined outcome is achieved by the player in at least one of the award-generating games.

24. The method of claim 23, wherein the additional award includes a progressive award.

25. The method of claim 23, which includes terminating the composite game if the predetermined outcome is achieved by the player.

26. The method of claim 17, wherein the award-generating game includes a path game, said path game including a plurality of adjacently interconnected positions wherein an indicator is moved from a first position to a second position of said plurality of positions and wherein the player is provided an outcome associated with the indicated second position.

27. The method of claim 26, wherein the path game includes a terminating event, wherein the terminating event includes indicating a second position having a terminating symbol associated with said second position.

28. The method of claim 26, which includes randomly determining the number of positions moved by the indicator from the first position to the second position.

29. The method of claim 17, wherein the award-generating game includes a selection game, wherein an award provided to the player is based on a symbol associated with a picked selection.

30. The method of claim 29, wherein the selection game includes a terminating event, wherein the terminating event includes picking at least one selection having a terminating symbol associated with said selection.

31. The method of claim 17, which includes at least one of the steps selected from the group consisting of:

a) controlling at least one of the award-generating games from at least one central processor;

b) downloading at least one of the award-generating games from at least one central processor;

c) downloading each of the award-generating games from at least one central processor; and d) downloading at least one of the award-generating games from at least one central processor, wherein the award-generating game downloaded from said central processor is controlled by said central processor.

32. The method of claim 17, which includes at least one of the steps selected from the group consisting of causing the at least one display device to display at least one of the award-generating games by a mechanical display device, and causing the at least one display device to display at least one of the award-generating games by a video display device.

* * * * *

UNITED STATES PATENT AND TRADEMARK OFFICE

CERTIFICATE OF CORRECTION

PATENT NO. : 7,874,904 B2
APPLICATION NO. : 11/205680
DATED : January 25, 2011
INVENTOR(S) : Randall It is certified that error appears in the above-identified patent and that said Letters Patent is hereby corrected as shown below:

IN THE CLAIMS:

In Claim 1, column 19, line 35, replace the ";" after "game" with a --,--.

In Claim 17, column 21, line 7, replace "with one" with --with at least one--.

Signed and Sealed this
Fifth Day of April, 2011

David J. Kappos

David J. Kappos
*Director of the United States Patent and Trademark Office*